US008699903B2

(12) United States Patent
Harashima

(10) Patent No.: US 8,699,903 B2
(45) Date of Patent: Apr. 15, 2014

(54) IMAGE FORMING APPARATUS AND IMAGE FORMING METHOD

(75) Inventor: Yasumitsu Harashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 278 days.

(21) Appl. No.: 13/208,958

(22) Filed: Aug. 12, 2011

(65) Prior Publication Data

US 2012/0213535 A1 Aug. 23, 2012

(30) Foreign Application Priority Data

Feb. 23, 2011 (JP) ..... 2011-036900

(51) Int. Cl.
*G03G 15/18* (2006.01)
*G03G 15/01* (2006.01)

(52) U.S. Cl.
USPC ..... 399/66; 399/299

(58) Field of Classification Search
USPC ..... 399/66, 302
See application file for complete search history.

(56) References Cited

U.S. PATENT DOCUMENTS 5,809,387 A * 9/1998 Takeuchi et al. ..... 399/302
5,920,747 A * 7/1999 Takemoto et al. ..... 399/53
6,505,010 B1 1/2003 Izumizaki et al.
6,651,894 B2 * 11/2003 Nimura et al. ..... 235/494
6,893,788 B2 * 5/2005 Takagi et al. ..... 430/108.6
7,356,296 B2 * 4/2008 Ito ..... 399/303
7,403,727 B2 * 7/2008 Fujimori et al. ..... 399/49
2006/0188277 A1 8/2006 Nishida et al.
2006/0256369 A1 * 11/2006 Mitamura ..... 358/1.15
2009/0016776 A1 1/2009 Priebe et al.

FOREIGN PATENT DOCUMENTS

JP 08-160784 A 6/1996

OTHER PUBLICATIONS

Australian Office Action issued Apr. 19, 2013 in corresponding Australian Application No. 2011224146.

* cited by examiner

*Primary Examiner* — Clayton E LaBalle
*Assistant Examiner* — Leon W Rhodes, Jr.
(74) *Attorney, Agent, or Firm* — Sughrue Mion, PLLC

(57) ABSTRACT

An image forming apparatus includes a first forming unit that forms a color image on a first image-carrier using a color toner, a first transfer unit that transfers the color image formed on the first image-carrier to a transfer medium at a first transfer bias, a second forming unit that, using an invisible toner absorbing infrared light or ultraviolet light, forms on a second image-carrier a code image representing information by an arrangement of dots, and a second transfer unit that transfers the code image formed on the second image-carrier to the transfer medium at a second transfer bias higher than the first transfer bias.

9 Claims, 5 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2011-036900 filed Feb. 23, 2011.

BACKGROUND (i) Technical Field

The present invention relates to an image forming apparatus and an image forming method.

(ii) Related Art

Techniques are available to control the density of an image in the formation of the image.

SUMMARY

According to an aspect of the invention, there is provided an image forming apparatus including a first forming unit that forms a color image on a first image-carrier using a color toner, a first transfer unit that transfers the color image formed on the first image-carrier to a transfer medium at a first transfer bias, a second forming unit that, using an invisible toner absorbing infrared light or ultraviolet light, forms on a second image-carrier a code image representing information by an arrangement of dots, and a second transfer unit that transfers the code image formed on the second image-carrier to the transfer medium at a second transfer bias higher than the first transfer bias.

BRIEF DESCRIPTION OF THE DRAWINGS

Exemplary embodiments of the present invention will be described in detail based on the following figures, wherein.

DETAILED DESCRIPTION

Figure 1:
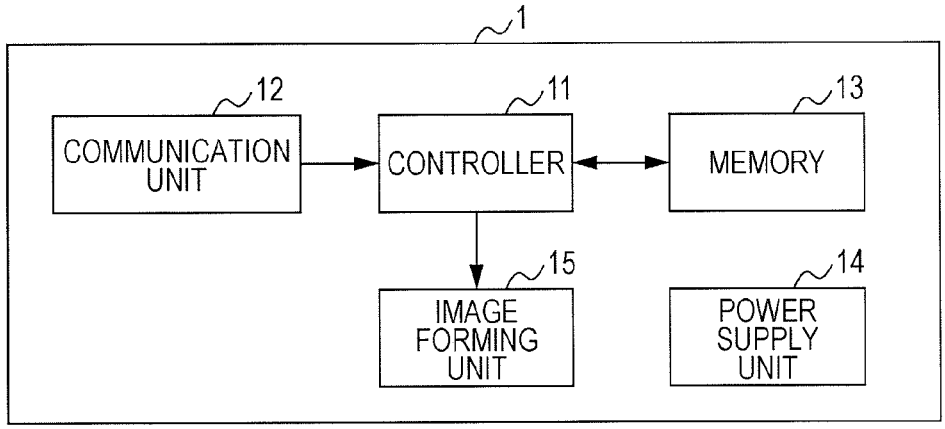
FIG. 1 illustrates a configuration of an image forming apparatus.

FIG. 1 illustrates a configuration of an image forming apparatus 1 of an exemplary embodiment. The image forming apparatus 1 includes controller 11, communication unit 12, memory 13, power supply unit 14, and image forming unit 15. The controller 11 includes a central processing unit (CPU) and a memory. The CPU executes a program stored on the memory, thereby controlling each element of the image forming apparatus 1. The communication unit 12 communicates with a terminal apparatus (not illustrated) via a communication line. The memory 13 includes a hard disk, for example, and stores a variety of data. The power supply unit 14 supplies power to each element of the image forming apparatus 1.

Figure 2:
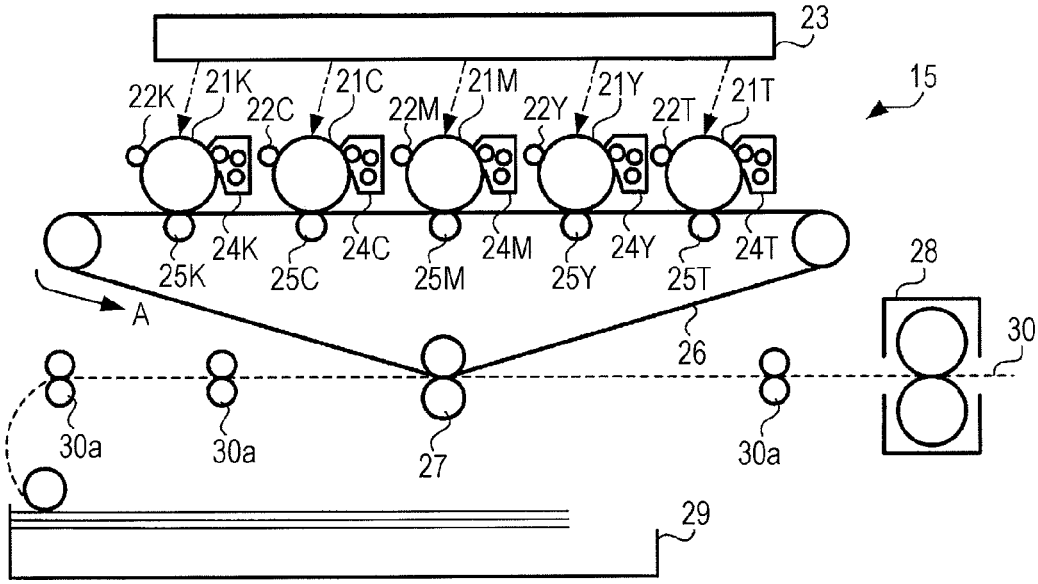
FIG. 2 illustrates a structure of an image forming unit.

FIG. 2 illustrates the image forming unit 15. The image forming unit 15 includes photoconductor drums 21Y, 21M, 21C, 21K, and 21T. The photoconductor drums 21Y, 21M, 21C, 21K, and 21T includes photoconductor layers thereof, and rotate about the axes thereof. Arranged around the photoconductor drums 21Y, 21M, 21C, 21K, and 21T are respectively charging devices 22Y, 22M, 22C, 22K, and 22T, exposing device 23, developing devices 24Y, 24M, 24C, 24K, and 24T, and first transfer rollers 25Y, 25M, 25C, 25K, and 25T.

The charging devices 22Y, 22M, 22C, 22K, and 22T electrically and uniformly charge the surfaces of the photoconductor drums 21Y, 21M, 21C, 21K, and 21T, respectively. The exposing device 23 exposes the charged photoconductor drums 21Y, 21M, 21C, 21K, and 21T to light, thereby forming electrostatic latent images. The developing devices 24Y, 24M, 24C, 24K, and 24T develop the electrostatic latent images formed on the photoconductor drums 21Y, 21M, 21C, 21K, and 21T with toner, thereby forming toner images. The developing devices 24Y, 24M, 24C, and 24K respectively form the toner images thereof using a yellow toner, a magenta toner, a cyan toner, and a black toner (as examples of color toners). The developing device 24T forms a toner image using an invisible toner. The invisible toner is a substantially transparent toner to visible light and absorbs infrared light or ultraviolet light. The invisible toner also absorbs visible light slightly. The invisible toner, if increased in amount, becomes easily visible to human eyes. The word "invisible" refers to a state at which the toner is set to be difficult to visually recognize, regardless of whether the invisible toner is actually invisible to human eyes or not.

The first transfer rollers 25Y, 25M, 25C, 25K, and 25T apply a transfer bias to the photoconductor drums 21Y, 21M, 21C, 21K, and 21T respectively, thereby transferring the toner images formed on the photoconductor drums 21Y, 21M, 21C, 21K, and 21T to an intermediate transfer belt 26. The power supply unit 14 supplies transfer currents to the first transfer rollers 25Y, 25M, 25C, 25K, and 25T. The controller 11 causes the power supply unit 14 to supply a standard transfer current to the first transfer rollers 25Y, 25M, 25C, and 25K (an example of a first transfer unit), and causes the power supply unit 14 to supply a transfer current higher than the standard transfer current to the first transfer roller 25T (an example of a second transfer unit). For example, the controller 11 causes the power supply unit 14 to supply a transfer current of 45 μA to the first transfer rollers 25Y, 25M, 25C, and 25K, and causes the power supply unit 14 to supply a transfer current of 50 μA to the first transfer roller 25T. In this way, the transfer bias of the first transfer roller 25T is higher than the transfer bias of the first transfer rollers 25Y, 25M, 25C, and 25K. In the discussion that follows, the transfer bias of the first transfer rollers 25Y, 25M, 25C, and 25K is referred to as a first transfer bias, and the transfer bias of the first transfer roller 25T is referred to as a second transfer bias.

The intermediate transfer belt 26 (an example of a transfer medium) turns in a direction denoted by an arrow A as illustrated in FIG. 2, and conveys the toner images transferred by the first transfer rollers 25Y, 25M, 25C, 25K, and 25T to a second transfer roller 27. The second transfer roller 27 then transfers the toner images transported by the intermediate transfer belt 26 to a recording medium. The recording medium is a paper sheet, for example. A fixing unit 28 fixes the toner images onto the recording medium by applying heat and pressure. A paper feed unit 29 holds multiple recording media, and then feeds the recording media one by one. A transport unit 30 includes multiple transport rollers 30*a*, and transports a paper sheet supplied by the paper feed unit 29 to a discharge port via the second transfer roller 27 and the fixing unit 28.

If a color image is formed, the image forming apparatus 1 performs the following operation using a mechanism for forming yellow, magenta, cyan, and black images. The color images refer to images other than a code image to be discussed below. The controller 11 acquires color image data representing the color image. For example, the controller 11 receives the color image data from a terminal apparatus (not illustrated) via the communication unit 12. The controller 11 generates an image signal responsive to the acquired color image data and supplies the generated image signal to the exposing device 23. The charging devices 22Y, 22M, 22C, and 22K electrically charge the surfaces of the photoconductor drums 21Y, 21M, 21C, and 21K (an example of a first image-carrier), respectively. In response to the image signal supplied from the controller 11, the exposing device 23 exposes at least one of the charged photoconductor drums 21Y, 21M, 21C, and 21K to light, and forms an electrostatic latent image corresponding to the color image. The developing devices 24Y, 24M, 24C, and 24K develop the electrostatic latent images formed on the photoconductor drums 21Y, 21M, 21C, and 21K using the yellow, magenta, cyan, and black toners, thereby forming color images. The charging devices 22Y, 22M, 22C, and 22K, the exposing device 23, and the developing devices 24Y, 24M, 24C, and 24K form an example of a first forming unit. The first transfer rollers 25Y, 25M, 25C, and 25K transfer the color images formed on the photoconductor drums 21Y, 21M, 21C, and 21K to the intermediate transfer belt 26 at the first transfer bias. The first transfer bias is a standard transfer bias that is set to achieve an excellent transfer efficiency.

If a code image is formed, the image forming apparatus 1 performs the following operation using a mechanism for forming an invisible toner image. The code image refers to an image representing specific information through small dots formed of the invisible toner. The controller 11 acquires code image data representing the code image. For example, the controller 11 receives the code image data from the terminal apparatus (not illustrated) via the communication unit 12. The controller 11 generates an image signal responsive to the acquired code image data, and then supplies the generated image signal to the exposing device 23. The charging device 22T (an example of the charging unit) charges the photoconductor drum 21T (an example of a second image-carrier). The exposing device 23 (an example of an exposing unit) exposes the charged photoconductor drum 21T to light in response to the image signal supplied by the controller 11, thereby forming an electrostatic latent image responsive to the code image. The developing device 24T (an example of a development unit) develops the electrostatic latent image formed on the photoconductor drum 21T with the invisible toner, thereby forming the code image. The charging device 22T, the exposing device 23, and the developing device 24T form an example of a second forming unit. The first transfer roller 25T transfers the code image formed on the photoconductor drum 21T to the intermediate transfer belt 26 at the second transfer bias. The second transfer bias is higher than the standard transfer bias. When the first transfer roller 25T performs a transfer operation, discharging happens. If discharging happens, the toner forming each dot of the code image is dispersed. The size of the dot may increase. In other words the second transfer bias is intended to set a dot size to be larger than when the code image is transferred at the first transfer bias.

A test conducted to verify the effect of the higher transfer bias is described. In the test, the dots A, B, and C are formed at a transfer current of 45 μA, and the diameters of the formed clots A, B, and C are measured. The same dots A, B, and C are formed at a transfer current of 50 μA, and then the diameters of the formed dots A, B, and C are measured.

The test conditions are described below:

Temperature: 22° C.

Humidity: 55%

Paper: OK topcoat paper 127.9 g/m$^2$ (manufactured by Oji Paper Co., Ltd)

Process speed: 440 mm/s

Developer: two-part developer

Development potential: 130 V

The process speed refers to a speed at which the image forming apparatus 1 forms an image.

Characteristics of the intermediate transfer belt 26 used in the test are described below:

Thickness: 100 μm

Young's modulus: 3400 MPa

Surface hardness: 35 mN/μm$^2$

Surface roughness: 1.5 μm

Surface resistivity: 12.8 Log Ω/sq (with a voltage of 500 V applied)

Volume resistivity: 12.6 Log Ω·cm (with a voltage of 500 V applied)

Figure 3:
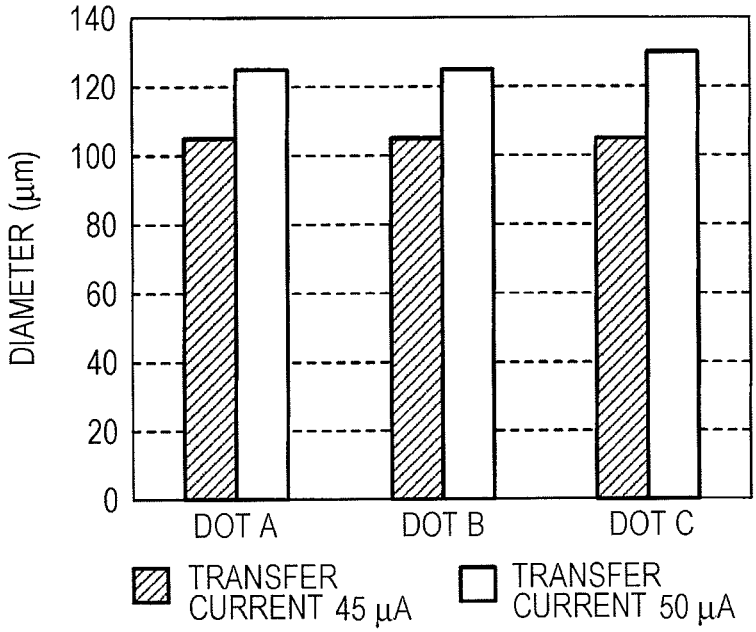
FIG. 3 illustrates diameters of dots A, B, and C.
Figure 4:
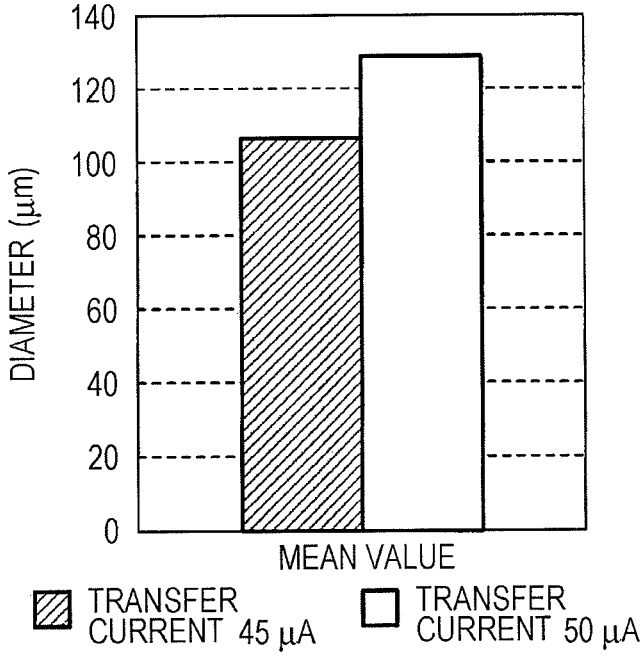
FIG. 4 illustrates mean values of the diameters of the dots A, B, and C.

FIGS. 3 and 4 illustrate the test results. FIG. 3 illustrates the diameters of dots A, B, and C measured in the test. FIG. 4 illustrates the mean values of the diameters of the measured dots A, B, and C measured in the test. At a transfer current of 45 μA, the diameter of the dot A is 103.56 μm, the diameter of the dot B is 105.18 μm, and the diameter of the dot C is 104.04 μm. The mean value of the diameters of the dots A, B, and C is 104.26 μm. At a transfer current of 50 μA, the diameter of the dot A is 125.36 μm, the diameter of the dot B is 124.84 μm, and the diameter of the dot C is 131.04 μm. The mean value of the diameters of the dots A, B, and C is 127.08 μm. The diameters of the dots A, B, and C are larger at a transfer current of 50 μA than at a transfer current of 45 μm. It is thus verified that an increase in the transfer bias increases the dot size.

Figure 5:
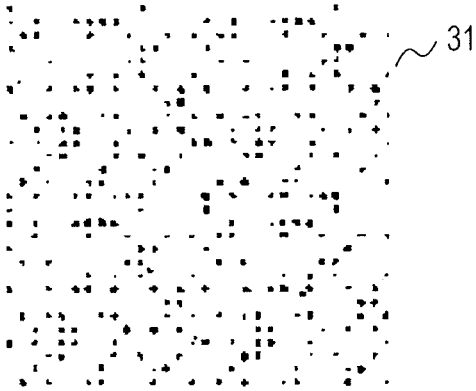
FIG. 5 illustrates a scan image at a transfer current of 45 μA.
Figure 6:
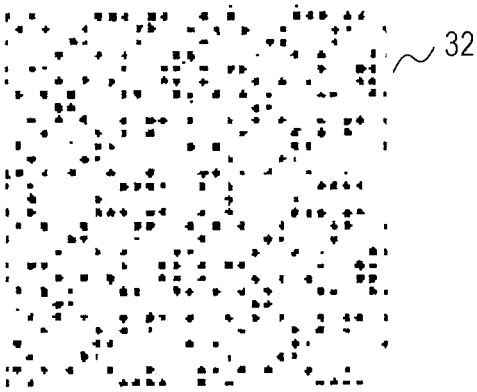
FIG. 6 illustrates a scan image at a transfer current of 50 μA.

A code image formed at a transfer current of 45 μA is read by a scanner radiating infrared light or ultraviolet light, and a scan image 31 is obtained. A code image formed at a transfer current of 50 μA is read by the same scanner, and a scan image 32 is obtained. FIG. 5 illustrates the scan image 31. FIG. 6 illustrates the scan image 32. Each of the scan images 31 and 32 includes plural dots. The dots of the scan image 32 are larger in size than the dots of the scan image 31. The number of read errors occurring in the generation of the scan image 31 is compared with the number of read errors occurring in the generation of the scan image 32. The number of read errors in the generation of the scan image 32 is about 50% less than the number of read errors in the generation of the scan image 31.

The invention is not limited to the exemplary embodiment, and may be modified. Modifications of the exemplary embodiment are described below. The modifications may be used in combination.

First Modification

Figure 7:
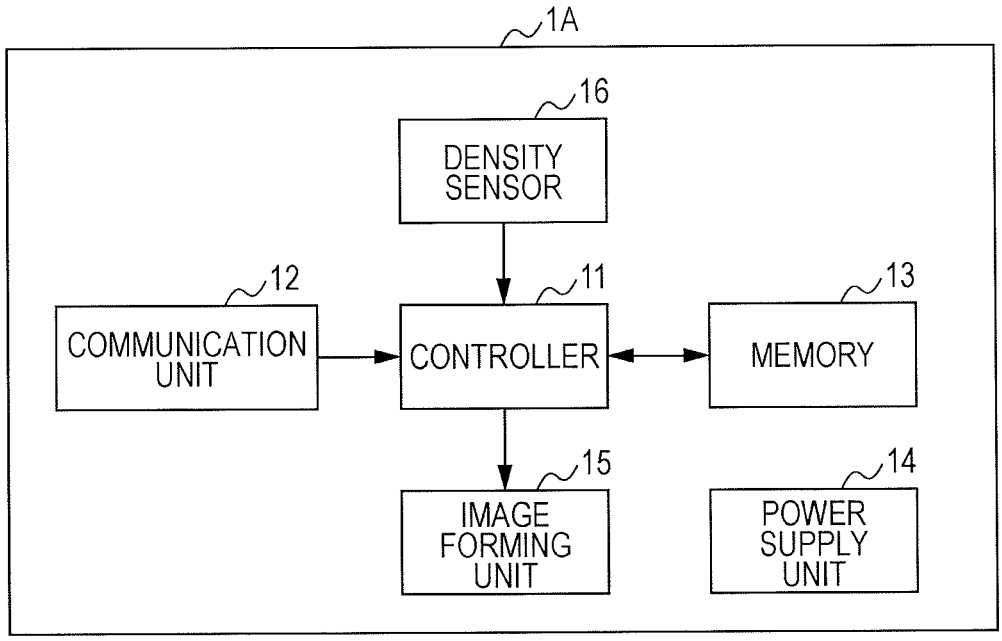
FIG. 7 illustrates a configuration of an image forming apparatus as a modification of an exemplary embodiment.

The transfer bias of the first transfer roller 25T may be set such that the density of dots of the code image is maximized. FIG. 7 illustrates a configuration of an image forming apparatus 1A of the first modification. The image forming apparatus 1A includes a density sensor 16 in addition the controller 11, the communication unit 12, the memory 13, the power supply unit 14, and the image forming unit 15 described above. The density sensor 16 (an example of a first measurement unit) is arranged above the intermediate transfer belt 26. The density sensor 16 radiates light onto the invisible toner image, and detects reflected light to measure an optical density of the invisible toner image.

Figure 8:
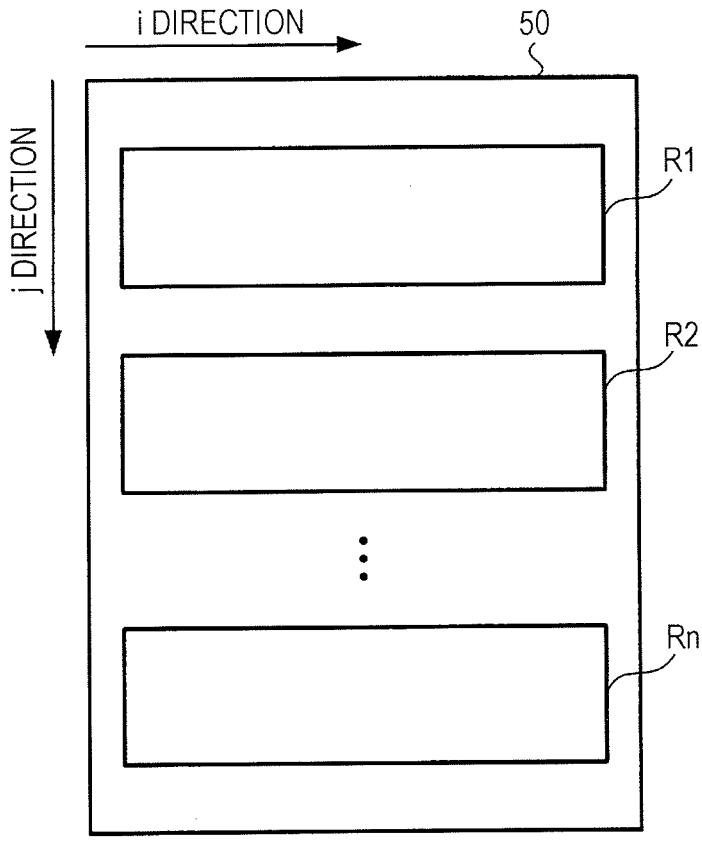
FIG. 8 illustrates an example of a patch image.

The memory 13 stores patch image data representing a patch image 50. FIG. 8 illustrates an example of the patch image 50. The patch image 50 includes regions R1, R2, . . . , Rn arranged in a j direction. In FIG. 8, an i direction represents a fast-scan direction of the exposing device 23, and the j direction represents a slow-scan direction of the exposing device 23. The controller 11 generates an image signal responsive to the patch image data stored on the memory 13, and then supplies the generated image signal to the exposing device 23. In response to the image signal supplied by the controller 11, the exposing device 23 exposes the charged photoconductor drum 21T to light, and forms an electrostatic latent image corresponding to the patch image 50. The developing device 24T then develops the electrostatic latent image formed on the photoconductor drum 21T with the invisible toner, thereby forming the patch image 50.

The controller 11 sets transfer biases B1, B2, . . . , Bn, each bias higher than the second transfer bias. When the patch image 50 is transferred, the controller 11 successively increases the transfer current to be supplied to the first transfer roller 25T such that the regions R1, R2, . . . , Rn of the patch image 50 are respectively transferred at the transfer biases B1, B2, . . . , Bn. By adding the transfer biases B1, B2, . . . , Bn successively to the photoconductor drum 21T, the first transfer roller 25T transfers the patch image 50 formed on the photoconductor drum 21T to the intermediate transfer belt 26. The regions R1, R2, . . . , Rn of the patch image 50 are thus transferred at different transfer biases B1, B2, . . . , Bn.

Figure 9:
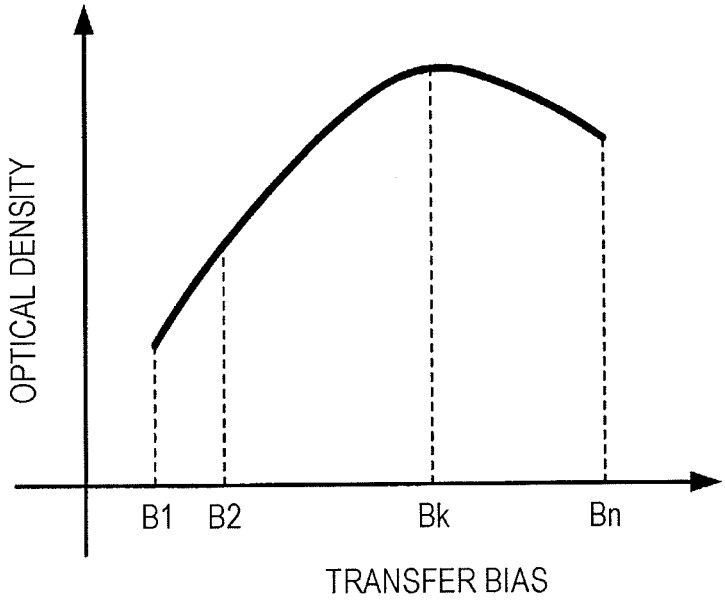
FIG. 9 illustrates a relationship between a transfer bias and an optical density.

The density sensor 16 successively measures the optical densities of the regions R1, R2, . . . , Rn of the patch image 50 transferred to the intermediate transfer belt 26. In response to the optical densities measured by the density sensor 16, the controller 11 determines a relationship between the transfer bias of the first transfer roller 25T and the optical densities of the regions of the patch image 50 transferred at the transfer biases. FIG. 9 illustrates the relationship between the transfer biases B1, B2, . . . , Bn and the optical densities of the regions R1, R2, . . . , Rn of the patch image 50. Within a transfer bias range from B1 to Bk, the optical density increases with the transfer bias. Beyond the transfer bias Bk, however, the optical density begins to fall. This is because an excessively high transfer bias causes an excessive amount of discharge, leading to a drop in a transfer efficiency. The controller 11 (an example of an identifying unit) identifies the transfer bias Bk responsive to a maximum optical density in accordance with the relationship. The transfer bias Bk refers to a bias that is used to transfer a region having the highest optical density from among the regions R1, R2, . . . , Rn of the patch image 50. The controller 11 sets the identified transfer bias Bk for the transfer bias of the first transfer roller 25T. The first transfer roller 25T transfers the code image at the set transfer bias Bk.

Second Modification

Figure 10:
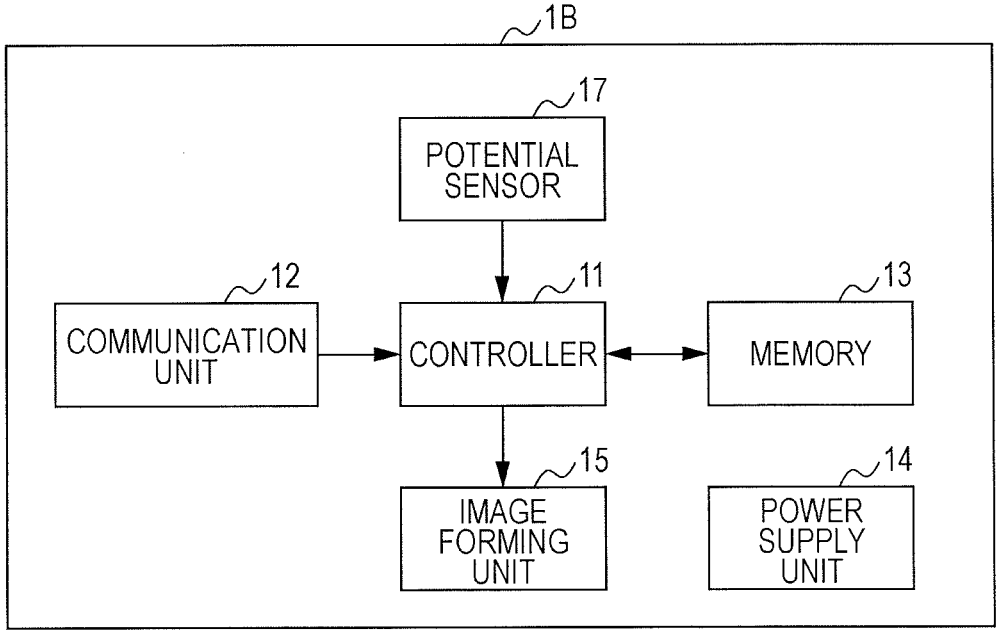
FIG. 10 illustrates an image forming apparatus of a modification of the exemplary embodiment.

The second transfer bias may be modified in response to a change in the development potential. FIG. 10 illustrates a configuration of an image forming apparatus 1B as a second modification. The image forming apparatus 1B includes a potential sensor 17 in addition to the controller 11, the communication unit 12, the memory 13, the power supply unit 14, and the image forming unit 15 described above. The potential sensor 17 (an example of a second measurement unit) is arranged beside the photoconductor drum 21T and measures a development potential of the photoconductor drum 21T in a contactless fashion subsequent to the development operation. If the development potential measured by the potential sensor 17 is lower than a threshold value, the controller 11 (an example of a transfer controller) increases the second transfer bias by increasing the transfer current supplied to the first transfer roller 25T. If the development potential is low, an amount of toner attached to the code image decreases. To allow the code image to be accurately read, the dot size is increased.

Third Modification

Figure 11:
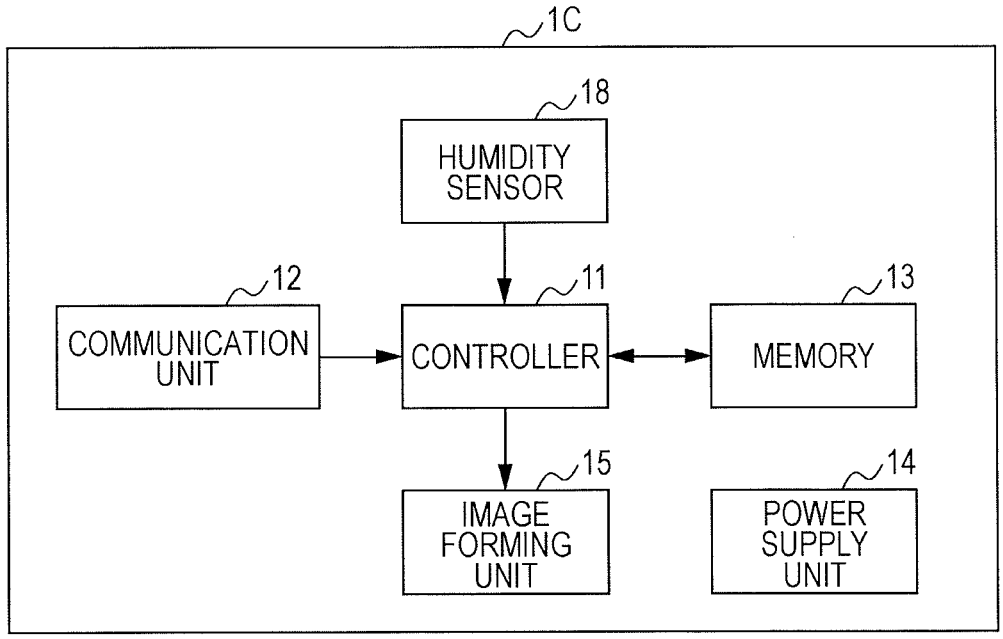
FIG. 11 illustrates an image forming apparatus of a modification of the exemplary embodiment.

The second transfer bias may be modified in response to a change in humidity. FIG. 11 illustrates a configuration of an image forming apparatus 1C of a third modification. The image forming apparatus 1C includes a humidity sensor 18 in addition to the controller 11, the communication unit 12, the memory 13, the power supply unit 14, and the image forming unit 15 described above. The humidity sensor 18 (an example of a third measurement unit) is arranged in the image forming apparatus 1C and measures humidity within the image forming apparatus 1C. If the humidity measured by the humidity sensor 18 is higher than a threshold value, the controller 11 increases the second transfer bias by increasing the transfer current supplied to the first transfer roller 25T. A high humidity is likely to lower the development potential. To allow the code image to be accurately read, the dot size is increased.

Fourth Modification

A color toner other than the yellow, magenta, cyan, and black toners may be used in the image forming apparatus 1. For example, a light cyan toner or a light magenta toner may be used. The color toners refer to toners other than the invisible toner.

Fifth Modification

The image forming apparatus 1 may be without the intermediate transfer belt 26 and transfer images formed on the photoconductor drums 21Y, 21M, 21C, 21K, and 21T directly onto a recording medium. In such a case, the recording medium serves as a transfer medium.

The image forming apparatus 1 may form an image through a rotary development system. In such a case, the image forming apparatus 1 may include one photoconductor drum and one first transfer roller. The developing devices 24Y, 24M, 24C, 24K, and 24T are changed in position such that the toner images are formed on the photoconductor drum. If a color image is formed, the first transfer roller transfers the color image at the first transfer bias. If a code image is formed, the first transfer roller transfers the code image at the second transfer bias.

Sixth Modification

The controller 11 may include an application specific integrated circuit (ASIC). The function of the controller 11 may be implemented using only ASIC, or using both ASIC and CPU.

Seventh Modification

A program implementing the function of the controller 11 may be supplied in a state recorded on one of computer readable recording media including magnetic recording media (such as a magnetic tape, and magnetic disks (hard disk drive (HDD), and floppy disk (FD)), magneto-optical recording media including optical discs (compact disc (CD), or digital versatile disc (DVD)) and a semiconductor memory, and then installed on the image forming apparatus 1. Alternatively, the program may be downloaded via a communication line and then installed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first forming unit that forms a color image on a first image-carrier using a color toner;

a first transfer unit that transfers the color image formed on the first image-carrier to a transfer medium at a first transfer bias;

a second forming unit that forms, using an invisible toner absorbing infrared light or ultraviolet light, a code image on a second image-carrier, the code image representing information by an arrangement of dots; and a second transfer unit that transfers the code image formed on the second image-carrier to the transfer medium at a second transfer bias higher than the first transfer bias to vary the size of dots of the code image transferred on the transfer medium.

2. The image forming apparatus according to claim 1, wherein the second forming unit forms a patch image including a plurality of regions on the second image-carrier using the invisible toner;

wherein the second transfer unit transfers to the transfer medium the regions, included in the patch image formed on the second image-carrier, at a set of transfer biases, each transfer bias of the set higher than the first transfer bias;

wherein the image forming apparatus further comprises:

a first measurement unit that measures a density of each of the regions included in the patch image transferred to the transfer medium, and an identifying unit that identifies a transfer bias that is used to transfer a region having the highest density from among the densities of the regions measured by the first measurement unit; and wherein the second transfer unit transfers the code image formed on the second image-carrier to the transfer medium at the transfer bias identified by the identifying unit.

3. The image forming apparatus according to claim 2, wherein the second forming unit includes a charging unit that electrically charges the second image-carrier, an exposing unit that exposes the charged second image-carrier to form a latent image responsive to the code image, and a development unit that develops the formed latent image with the invisible toner;

wherein the image forming apparatus further comprises:

a second measurement unit that measures a development potential of the second image-carrier subsequent to the development of the latent image, and a transfer controller that controls the second transfer bias to a higher value if the development potential measured by the second measurement unit is lower than a threshold value.

4. The image forming apparatus according to claim 2, further comprising:

a third measurement unit that measures humidity within the image forming apparatus; and a transfer controller that controls the second transfer bias to a higher value if the humidity measured by the third measurement unit is higher than a threshold value.

5. The image forming apparatus according to claim 1, wherein the second forming unit includes a charging unit that electrically charges the second image-carrier, an exposing unit that exposes the charged second image-carrier to form a latent image responsive to the code image, and a development unit that develops the formed latent image with the invisible toner;

wherein the image forming apparatus further comprises:

a second measurement unit that measures a development potential of the second image-carrier subsequent to the development of the latent image, and a transfer controller that controls the second transfer bias to a higher value if the development potential measured by the second measurement unit is lower than a threshold value.

6. The image forming apparatus according to claim 1, further comprising:

a third measurement unit that measures humidity within the image forming apparatus; and a transfer controller that controls the second transfer bias to a higher value if the humidity measured by the third measurement unit is higher than a threshold value.

7. The image forming apparatus of claim 1, wherein the first image-carrier and the second image-carrier contact the transfer medium, the second forming unit is disposed on a same side of the transfer medium as the first forming unit, and the second forming unit is disposed at an upstream side of the first forming unit with respect to a movement direction of the transfer medium.

8. An image forming method comprising:

forming a color image on a first image-carrier using a color toner;

transferring the color image formed on the first image-carrier to a transfer medium at a first transfer bias;

forming, using an invisible toner absorbing infrared light or ultraviolet light, a code image on a second image-carrier, the code image representing information by an arrangement of dots; and transferring the code image formed on the second image-carrier to the transfer medium at a second transfer bias higher than the first transfer bias to vary the size of dots of the code image transferred on the transfer medium.

9. An image forming apparatus comprising:

a first forming unit that forms a color image on a first image-carrier using a color toner;

a first transfer unit that transfers the color image formed on the first image-carrier to a transfer medium at a first transfer bias;

a second forming unit that forms, using an invisible toner absorbing infrared light or ultraviolet light, a code image on a second image-carrier, the code image representing information by an arrangement of dots; and a second transfer unit that transfers the code image formed on the second image-carrier to the transfer medium at a second transfer bias higher than the first transfer bias, wherein the first image-carrier and the second image-carrier contact the transfer medium, the second forming unit is disposed on a same side of the transfer medium as the first forming unit, and the second forming unit is disposed at an upstream side of the first forming unit with respect to a movement direction of the transfer medium.

* * * * *